US006015056A

United States Patent [19]

Overholt et al.

[11] Patent Number: 6,015,056

[45] Date of Patent: Jan. 18, 2000

[54] COLLAPSIBLE CONTAINER

[75] Inventors: Trenton M. Overholt, Playa Del Rey, Calif.; William Patrick Apps, Alpharelta, Ga.; Gerald R. Koefelda, Hermosa Beach, Calif.

[73] Assignee: Rehrig Pacific Company, Los Angeles, Calif.

[21] Appl. No.: 08/994,061

[22] Filed: Dec. 19, 1997

[51] Int. Cl.[7] ..... B65D 6/12

[52] U.S. Cl. ..... 220/6; 220/7

[58] Field of Search ..... 220/6, 7, 675, 220/324

[56] References Cited

U.S. PATENT DOCUMENTS

| | | | |
|---|---|---|---|
| D. 306,264 | 2/1990 | Malmanger . | |
| B 513,789 | 2/1976 | Koen . | |
| 3,446,415 | 5/1969 | Bromley . | |
| 3,628,683 | 12/1971 | Friedrich et al. . | |
| 3,874,546 | 4/1975 | Sanders et al. . | |
| 3,973,692 | 8/1976 | Cloyd . | |
| 4,005,795 | 2/1977 | Mikkelsen et al. . | |
| 4,044,910 | 8/1977 | Box . | |
| 4,062,467 | 12/1977 | Friedrich | 220/7 |
| 4,081,099 | 3/1978 | Shead . | |
| 4,170,313 | 10/1979 | Caves et al. . | |
| 4,181,236 | 1/1980 | Prodel . | |
| 4,300,695 | 11/1981 | Hsu . | |
| 4,349,120 | 9/1982 | DiNardo . | |
| 4,474,200 | 10/1984 | Nicholson . | |
| 4,663,803 | 5/1987 | Gora . | |
| 4,674,647 | 6/1987 | Gyenge et al. . | |
| 4,735,331 | 4/1988 | Keenan et al. | 220/7 X |
| 4,741,032 | 4/1988 | Hampton . | |
| 4,765,480 | 8/1988 | Malmanger . | |
| 4,775,068 | 10/1988 | Reiland et al. . | |
| 4,776,457 | 10/1988 | Ferraroni . | |
| 4,781,300 | 11/1988 | Long . | |
| 4,809,874 | 3/1989 | Pehr . | |
| 4,846,089 | 7/1989 | Cedergreen . | |
| 4,887,747 | 12/1989 | Ostrowsky et al. . | |
| 4,923,079 | 5/1990 | Foy . | |
| 4,940,155 | 7/1990 | Hewson . | |
| 4,960,223 | 10/1990 | Chiang et al. . | |
| 4,967,927 | 11/1990 | Reiland et al. . | |
| 4,979,634 | 12/1990 | Begley . | |
| 5,038,953 | 8/1991 | Radar . | |
| 5,048,715 | 9/1991 | Wolff . | |
| 5,114,037 | 5/1992 | Hillis et al. . | |

(List continued on next page.)

FOREIGN PATENT DOCUMENTS

| | | |
|---|---|---|
| 0 127 414 | 5/1984 | European Pat. Off. . |
| 0 178211 A1 | 9/1985 | European Pat. Off. . |
| 0 404041 A1 | 6/1990 | European Pat. Off. . |
| 27 34 964 A1 | 2/1979 | Germany . |
| WO 86/01182 | 2/1986 | WIPO . |
| WO 97/15502 | 1/1997 | WIPO . |

*Primary Examiner*—Steven Pollard
*Attorney, Agent, or Firm*—Brooks & Kushman P.C.

[57] ABSTRACT

A collapsible container orientable between assembled and collapsed positions having a base, a pair of side walls and a pair of end walls. The base has a pair of opposing upstanding end flanges integral thereto defining a corner line at each end and a side face member perpendicular. A pair of opposing side edges lie in a plane parallel to and spaced inward from an adjacent co-planar pair of side face members and extending therebetween. Opposing side walls are pivotably attached to one of the opposing side edges, forming an extension of the base when the container is in assembled. Each side wall has a latch member at each lateral edge having upper and lower curved surfaces and a tooth at its distal end. Each end wall has a pair of flanges with an opening sized to slidingly receive a latching member in the assembled state and is securely held by a living hinge. The container is adapted to being nestable when in the collapsed position.

18 Claims, 10 Drawing Sheets

U.S. PATENT DOCUMENTS 5,161,709 11/1992 Oestreich, Jr. .
5,183,180 2/1993 Hawkins et al. .
5,289,935 3/1994 Hillis et al. .
5,328,048 7/1994 Stein .
5,353,948 10/1994 Lanoue et al. .
5,398,834 3/1995 Umiker .
5,474,197 12/1995 Hillis et al. .
5,515,987 5/1996 Jacques, et al. ..... 220/6
5,588,549 12/1996 Furtner .
5,622,276 4/1997 Simmons .
5,632,392 5/1997 Oh .
5,699,926 12/1997 Jacques et al. .
5,829,617 11/1998 Umiker .
5,850,936 12/1998 Umiker .
5,853,099 12/1998 Lessard .

COLLAPSIBLE CONTAINER

TECHNICAL FIELD

This invention relates to a multi-purposed collapsible container for the storage and transport of produce items and other goods.

BACKGROUND ART

Collapsible containers and crates are commonly used to transport and store a variety of items. Such crates are typically formed of injection molded plastic and are frequently adapted to receive perishable food items, such as produce. When assembled, such containers are rectangular in shape and have a flat base surrounded by four upstanding side panels which are joined to the flat base. When the containers are not in use, the collapsible feature of the containers allows the containers to be folded or otherwise reduced in size, thereby providing a desired compact size when storage space is minimal.

In such collapsible containers, side wall edges are normally joined in the corners. However, for an assembled container during use, this corner system results in a less rigid container due to the corners being subjected to torsional and other bending forces during use. Accordingly, the corners are commonly a focal point of stress in containers of this type. Further, the various types of latching and locking mechanisms available for containers of this type are typically subject to the similar forces resulting in a less rigid container when assembled.

Consequently, there is a need for an improved collapsible container which has latching located to minimize the stress concentration present in current containers. The latching or locking system of the improved collapsible container should also include a stable and rigid structure when in use. The container should also be capable of nesting with like containers when collapsed.

SUMMARY OF THE INVENTION

It is an object of the present invention to provide a collapsible container which minimizes corner stress concentration.

It is another object according to the present invention to provide a collapsible container which includes a latching mechanism between adjacent upstanding walls for fostering a stable and rigid container structure.

It is still another object according to the present invention to provide a collapsible container having improved stability which is movable from its collapsed to its assembled state with relative ease and is also cost effective to manufacture.

Moreover, it is an object according to the present invention to provide a collapsible container which is able to nest with like containers when in the collapsed position, for stacking and storage purposes.

In carrying out the above objects, features and advantages of the present invention, provided is a collapsible container which includes a base, a first pair of opposed sidewalls, and a second pair of opposed sidewalls. The base includes first and second pairs of opposing edges. One of the first and second pairs of opposing edges is defined by an upstanding base wall, where the base wall has a pair of upstanding corner portions which are integrally formed with the base wall. Each corner portion has a side face wall portion which defines a surface plane and a transverse plane perpendicular to the surface plane. The other of the first and second pairs of opposing edges lies in a plane parallel to and spaced inward from a pair of co-planar side face walls. This other of the first and second pairs also extends between the pair of transverse planes.

The collapsible container also includes a first pair of opposed sidewalls. Each of the first pair of opposed sidewalls is pivotally attached to a corresponding one of the first and second pair of opposing edges of the base at a distance remote from the corner portions. Each of the first pair of opposing sidewalls has a pair of opposing lateral flanges which inwardly depend therefrom and which are integrally formed thereto. Each lateral flange has a latch receiver aperture formed therethrough.

The collapsible container also includes a second pair of opposing sidewalls. Each of the second pair of opposing sidewalls (or end walls) is pivotably attached to a corresponding other one of the first and second pair of opposing edges of the base at a distance remote from the corner portions. Like the first pair, each of the second pair of opposing sidewalls defines a pair of opposing lateral edges, and each lateral edge has a latching member integrally attached thereto.

Thus, when the container is oriented in an assembled position, each lateral flange of the first pair of opposing sidewalls abuts an adjacent lateral edge of the second pair of opposing sidewalls. In this orientation, each latch receiver aperture receives a corresponding latching member thereby forming a secure attachment between the pairs of first and second opposing sidewalls, and thus any resulting stress is remote from the corner portions.

In another embodiment, the container is oriented in a first disassembled position so that the first and second pairs of opposing sidewalls are pivotably folded inward. In this orientation, one of the first and second pairs of opposing sidewalls is layered between the other of the first and second pairs of opposing sidewalls and the base. When the container is oriented in a second disassembled position, the first and second pairs of opposing sidewalls are pivotably folded outward from the base.

In yet another embodiment, each lateral flange of the first pair of opposing sidewalls has an opening, and each lateral edge of the second pair of opposing sidewalls has attached thereto large tab member. Thus, when the container is oriented in the assembled position, each opening receives a corresponding large tab member which forms an interference fit to assist in aligning adjacent sidewalls. In still another embodiment, each corner portion defines a corner line. Thus, when the container is oriented in the assembled position, each lateral flange abuts an adjacent lateral wall edge along a line distal from an adjacent corner line.

According to the teachings of the present invention, there is also provided a collapsible crate which is orientable between an assembled position and a collapsed position. This crate has a base which has a pair of opposing upstanding end flanges integrally formed with the base and defining a corner line at each end. The base also includes a side face member adjacent each corner line, oriented perpendicular to the corner line, and integrally formed with the corner line. The base further includes a pair of opposing side edges, each lying in a plane parallel to and spaced inward from an adjacent co-planar pair of side face members, and extending between the co-planar pair of side face members.

This collapsible crate also includes a pair of opposing side walls having an L-shaped cross-section defined by a long wall and a relatively short wall. The short wall is pivotably attached to a corresponding one of the opposing side edges of the base and, when the crate is oriented in the assembled position, forms an extension of the base. In the assembled position, the long wall is co-planar to the adjacent pair of side face members. Each side wall further has a latching member disposed at each lateral edge, where the latching member has upper and lower curved surfaces and a latching tooth disposed at its distal end.

The collapsible crate also includes a pair of opposing end walls each having a pair of flanges orthogonal thereto. The flanges have an opening sized to slidingly receive a corresponding latching member as the container is moved from the collapsed position to the assembled position. In this situation, the tooth extends beyond the end wall and locks into position.

Moreover, provided in the teachings according to the present invention is foldable container which is orientable in an assembled state and an inwardly folded collapsed state. The foldable container includes a bottom panel which has a pair of integrally formed opposed upstanding flanged edges. Each of the upstanding flanged edges includes at each end an integral upstanding corner member which has a planar end portion, a planar side portion and a corner line defined between the planar end portion and planar side portion. The bottom panel further includes a pair of opposed side edges each situated along a plane inward an adjacent planar side portion.

The foldable container also includes a pair of opposed side walls having an L-shaped cross-section which is defined by a long wall portion and a relatively shorter wall portion. The shorter wall portion is pivotably attached to a corresponding one of the pair of opposed side edges, so that when the container is oriented in the assembled state the short wall portion forms an extension of the base. In this assembled state, the long wall portion is co-planar with the planar side portion. Each of the opposed side walls further has a latching member disposed at each lateral edge. The latching member has upper and lower curved surfaces and a tooth member disposed at its distal end.

The foldable container also includes a pair of opposed end walls, each pivotably attached to a corresponding one of the upstanding flanged edges. Each end wall has a U-shaped cross-section including a longer main wall portion and a pair of relatively shorter flanged portions attached to the lateral edges of the main wall portion and extending inwardly therefrom. Each flanged portion has an aperture formed therein which is correspondingly shaped to slidingly receive the locking member.

When the container is oriented in the assembled state, the pair of side walls and the pair of end walls are upstanding. Thus, the locking member is disposed in the aperture and the tooth member extends beyond the aperture to lock into the corresponding end wall. When the container is oriented in the inwardly folded collapsed state, each of the end walls and side walls is folded inward so that the pair of side walls is disposed between the bottom panel and the pair of end walls. In this state, each shorter flanged portion abuts a corresponding planar side portion of a respective corner member. In another embodiment, the container is also orientable in an outwardly folded collapsible state where the pair of side panels is co-planar with the bottom panel. The container may also be nestable with like containers.

The above objects and other objects, features, and advantages of the present invention are readily apparent from the following detailed description of the best modes for carrying out the invention when taken in connection with the accompanying drawings.

BEST MODE FOR CARRYING OUT THE INVENTION

Figure 1:
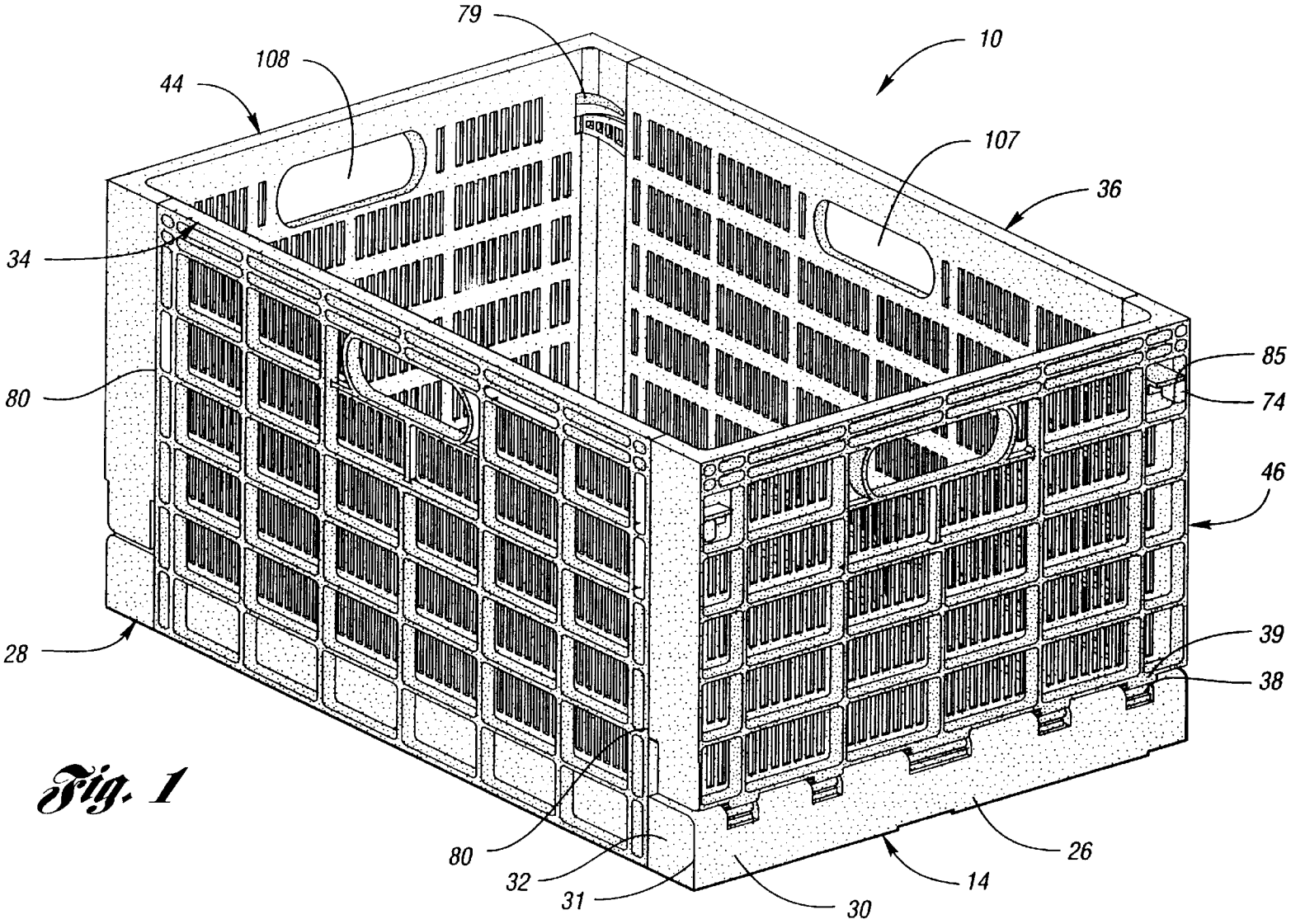
FIG. 1 of the drawings illustrates the collapsible container according to the present invention oriented in an assembled state.

With reference to FIG. 1 of the drawings, illustrated therein is collapsible container 10. The components of container 10 are typically formed of various types of plastic or polymeric material via an injection molding or other plastic molding process suitable to this application. Collapsible container 10 may be used for the storage or transport of goods, and may also be referred to as a collapsible crate. Container 10 is particularly suitable for the transport of produce such as fruits and vegetable, where circulation of air and /or refrigerated gas is necessary to keep the produce fresh and consumable while it reaches the market. This circulation is fostered through the plurality of slots 12 provided on each panel over the entire container, as fully shown in FIGS. 1–3, and as best shown in FIG. 2.

Collapsible container 10 includes a base member 14 having a bottom panel 15 which serves as the lower support for the container. As is best shown in the outwardly folded configuration of FIG. 2, bottom panel 15 is generally rectangular in shape and has four edges—namely, a pair of opposed offset side edges 16 and 18, and a pair of opposed end edges 20 and 22. Base 14 further includes integrally molded upstanding flanges 24 and 26 (or base walls) oriented perpendicular to bottom panel 15, each defining an upper side edge 25 and 27, respectively. As is well understood in the art, the wall thickness of each of the walls and components illustrated and disclosed herein may vary depending on the intended usage and other characteristics desired from container 10.

Base 14 further includes four upstanding corner members 28 situated, of course, at each corner of bottom panel 15. As with the upstanding flanges, each corner member 28 is preferably integrally molded to bottom panel 15 and to upstanding flanges 24 and 26. Specifically, each corner member 28 includes an end face portion 30 (or end face member or wall) which is integral with its adjacent upstanding flange (24 and 26). Each corner portion 28 also includes a side face portion 32 (or side face member or wall) which is oriented perpendicular to end face portion 30. As shown in FIG. 1, end face portion 30 and side face portion 32 define a corner line 31 which is perpendicular to bottom panel 15.

Figure 2:
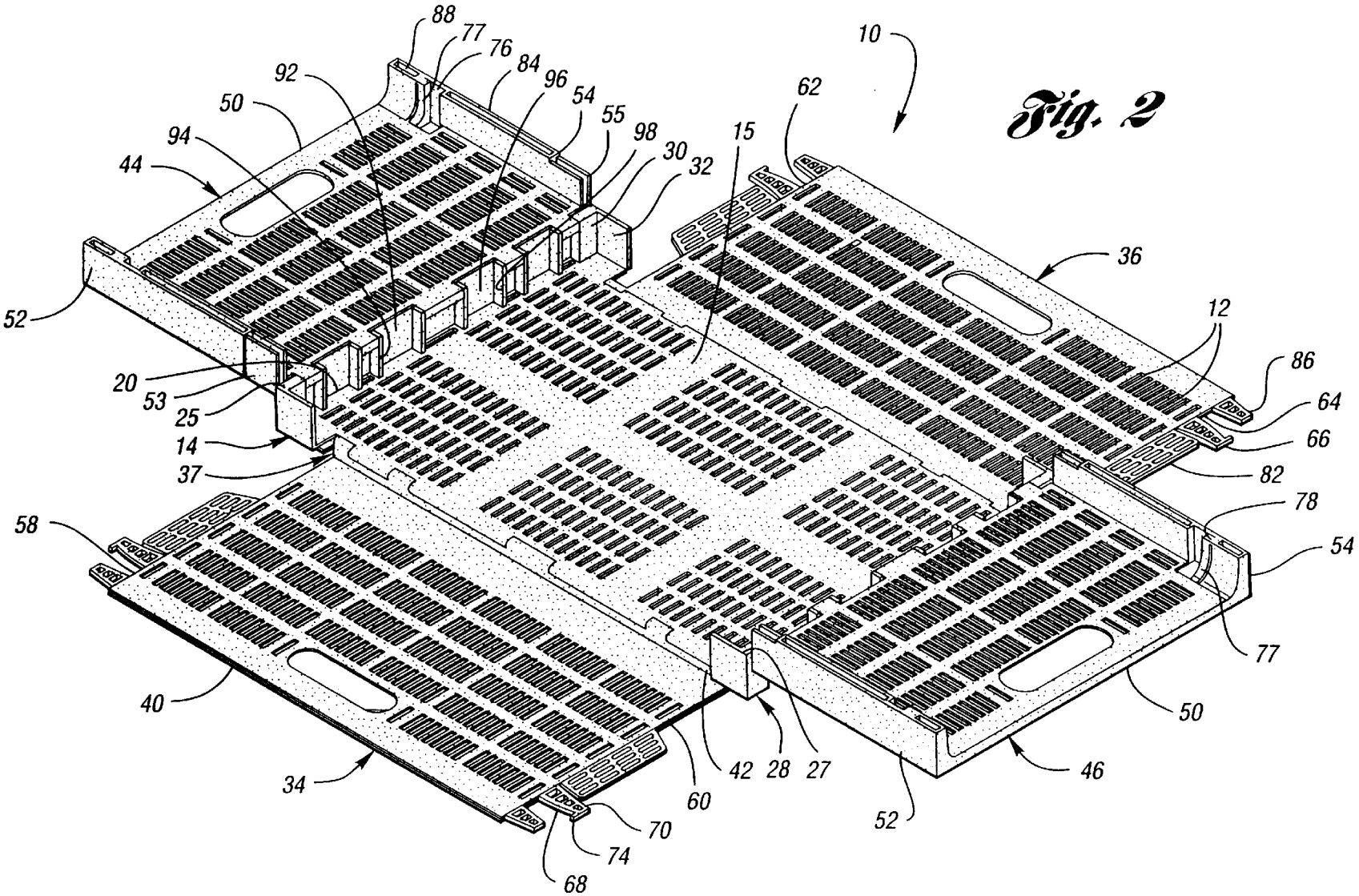
FIG. 2 of the drawings illustrates the collapsible container of FIG. 1 oriented in an outwardly collapsible state.
Figure 3:
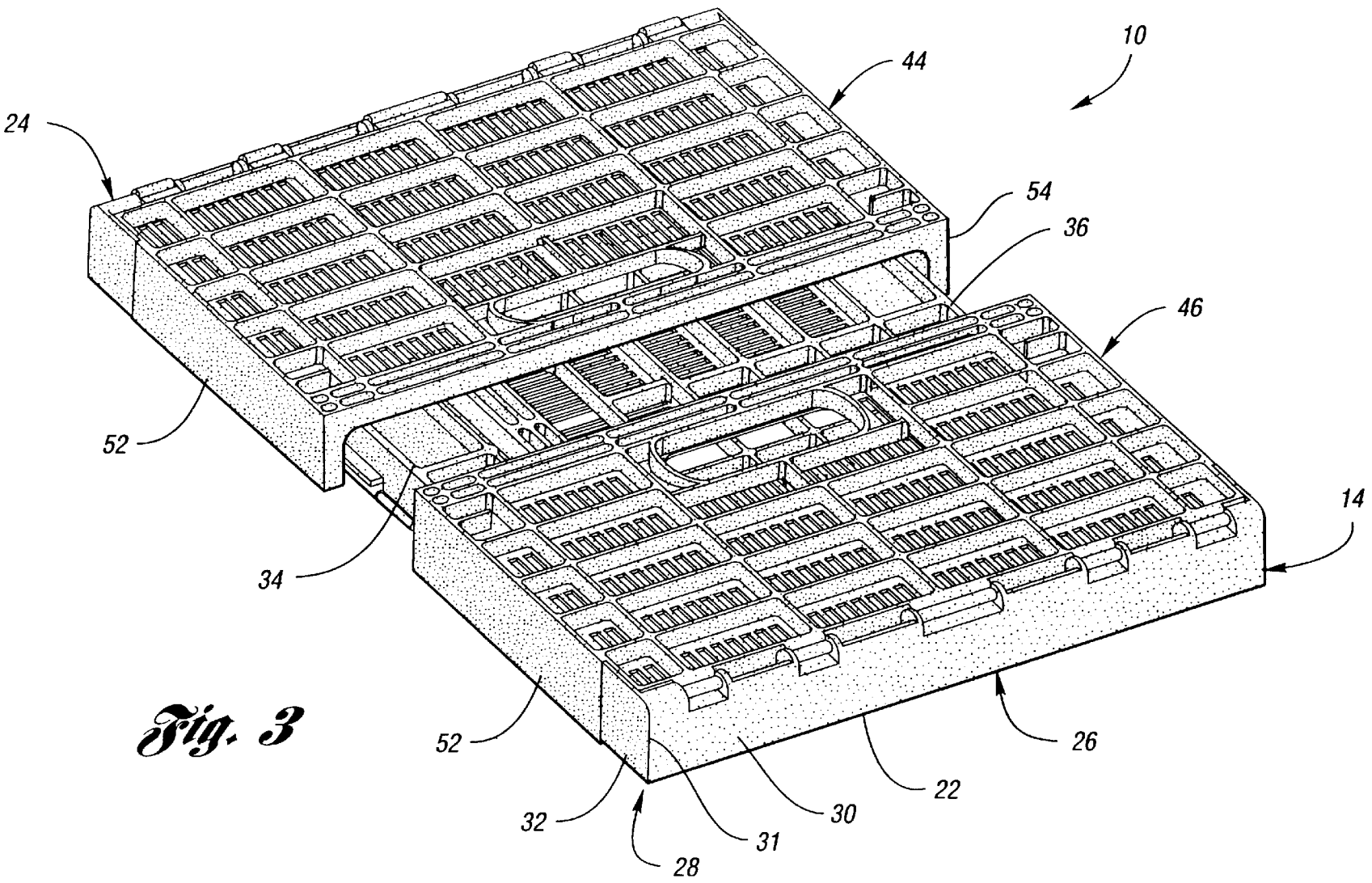
FIG. 3 of the drawings illustrates the container of FIGS. 1–2 oriented in an inwardly collapsible state.

As shown in FIGS. 1–2, collapsible container 10 also includes a first pair of opposed side walls 34 and 36, which are situated opposite each other across bottom panel 15. Side walls 34 and 36 are each pivotably attached to bottom panel 15 by way of a hinging configuration or system 37, located at edges (16,18) of bottom panel 15. Thus, side walls (34, 36) fold or pivot relative to bottom panel 15 at edges 16 and 18, which are shown inwardly offset from side face portion 32, as shown in FIG. 2. Such hinging system 37 allows side walls 34 and 36 to be foldably positioned in three orientations: the assembled container orientation, as illustrated in FIG. 1; the outwardly collapsible orientation, as illustrated in FIG. 2; and the inwardly collapsible orientation, as illustrated in FIG. 3. As seen in FIG. 2, hinging system 37 does not extend the length of base 14 but terminates at a distance away from each upstanding flange 24 and 26, as well as a distance remote from an adjacent corresponding corner line 31.

Each side wall 34 and 36 has an L-shaped cross-section, best shown in FIG. 2. L-shaped cross section includes a long wall section 40 and a relatively shorter wall section 42. When container 10 is in the assembled orientation of FIG. 1, shorter wall portion 42 pivotably attaches to a respective side edge (16,18) to become co-planar with bottom panel 15 and serve as an extension of bottom panel 15 for completing the rectangularity of bottom panel 15 thereby compensating for the offset nature of sides 16,18. As a result, because no hinge is located between long wall section 40 and shorter wall section 42, stress is minimized on that intermediate edge.

Figure 4:
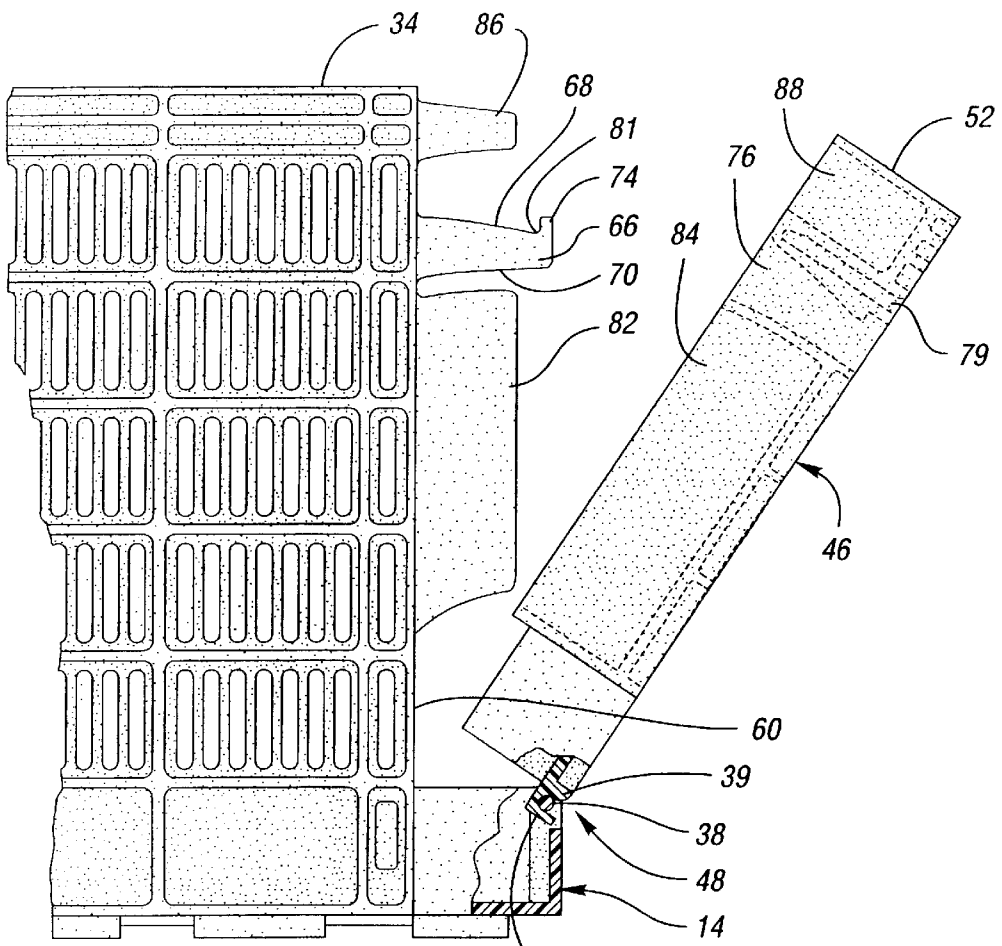
FIG. 4 of the drawings is a partial side view of container according to the present invention with a partial section of the hinging mechanism.

As seen in FIGS. 1 and 4, hinging mechanism 37 includes cylindrical members 38 which are spaced across the length of the shorter wall section 42 of each side wall 34 and 36. Cylindrical members 38 are integrally molded to base 14 proximate each side edge 16, 18. Attached to short wall section 42 at each cylindrical member 38 is a member 39 having a C-shaped cross-section which latches onto and receives cylindrical member 38 across its length, thus allowing side walls 34 and 36 to pivot and fold with respect to bottom panel 15 with minimal wearing of hinging mechanism 37. This system is representatively shown in FIG. 4 as applied to a similarly configured system 48 in which end wall 46 and pivots in relation to base 14, as discussed further herein. Of course, it is contemplated that this hinging system is capable of being operable in another configuration, namely with cylindrical member 38 formed integrally with side walls (34, 36) and C-shaped member 39 being formed on bottom panel 15 for securely receiving cylindrical member 38.

Further, as best shown in FIG. 2, each member 39 having a C-shaped cross-section includes a flat portion 43 disposed thereon and integrally molded thereto. Flat portion 43 serves as a detent causing hinging portions to pause when each side wall (34, 36) is raised from one of the collapsed states to an upstanding position in preparation for assembly. In other words, flat portion 43 prevents the user from having to hold each side wall (34,36) in position while end walls (44,46) are being raised to the upright position in preparation for assembly. When container 10 is collapsed, the user need only push the side wall past the point at which it pauses.

As illustrated in FIGS. 1–3, collapsible container 10 further includes a second pair of opposing side walls 44 and 46. Of course, for ease of reference and discussion, second pair of side walls is herein designated as a pair of end walls 44 and 46, which is appropriate nomenclature for the generally rectangular base configuration. Like side walls 34 and 36, end walls 44 and 46 are similarly pivotably attached to bottom panel 15 by way of a hinging mechanism 48 which is similar in structure to hinging mechanism 37 described above, as seen in FIG. 4. However, unlike the side walls, end walls (44, 46) are folded relative to base 14 at a distance remote from bottom panel 15. Particularly, end walls 44 and 46 are pivotably attached to upstanding flanges 24 and 26, respectively, of bottom panel 15, proximate upper edges 25, 27. The height of upstanding flanges (24, 26) defines the aforementioned distance remote from bottom panel 15. As with the other walls discussed herein, end walls 44 and 46 are orientable in three positions: assembled shown as in FIG. 1; outwardly collapsed as in FIG. 2; and inwardly collapsed as in FIG. 3. The hinging system used for end walls 34 and 36 is similar to that described above in association with side walls 34 and 36. This system is shown as a partial sectional view in FIG. 4, detailing cylindrical member 38 and C-shaped member 39. As with hinging mechanism 37, in a preferred embodiment hinging mechanism 48 does not extend to corner line 31 but is remote therefrom.

As best shown in FIG. 2, each end wall 44 and 46 has a U-shaped cross section formed by a main end wall portion 50, and two shorter flange portions 52 and 54 integrally attached to main end wall portion 50 and located on either side of main end wall portion 50. Flange portions 52 and 54 are oriented orthogonal to main end wall portion 50 and, in the assembled orientation of FIG. 1, are directed inward toward base 14 and side walls 34 and 36, respectively.

In accordance with the teachings of the present invention, further included in container 10 is a locking or latching mechanism for latching side walls (34, 36) together with end walls (44 and 46) to achieve the desired stability when container 10 is oriented in assembled position, as in FIG. 1. To perform these locking and latching functions, reference must be directed to FIG. 2 and particularly to FIG. 5. Provided on each lateral edge (58, 60) and (62, 64) of side walls 34 and 36, respectively, is a latching member 66 extending outwardly therefrom. As best shown in FIG. 2, each latching member 66 has a slightly curved upper surface 68, preferably convex, and a slightly curved lower surface 70, preferably concave. Further, disposed at a distal end of latching member 66 is a tooth 74.

Figure 5:
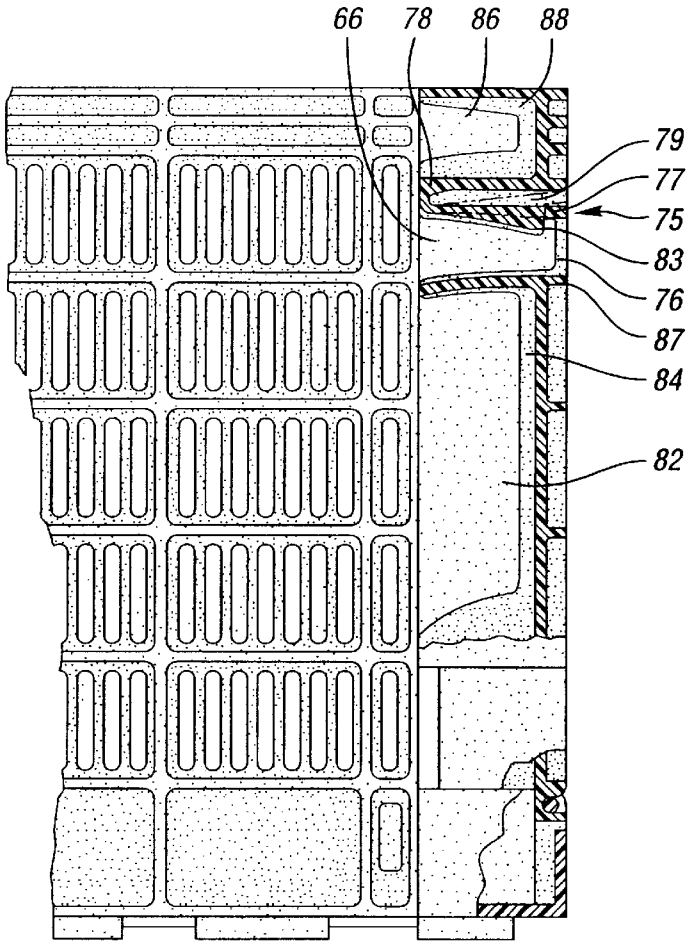
FIG. 5 of the drawings is a partial side view of the container according to the present invention with a partial section of the side wall flanges and latch system.

By way of example with respect to FIG. 5, for latching purposes, shorter flange 52 and 54 of end wall 46 has a latch receiver 75 provided for receiving latching member 66. Latch receiver 75 includes a latch receiving aperture 76 and a living hinge 77. Aperture 76 is defined by the upper wall 87 of opening 84 and the lower surface of living hinge 77. Particularly, as shown in FIG. 1, aperture 76 is appropriately sized and shaped to firmly receive latching member 66. Adjacent to aperture 76 is living hinge 77, which is attached to each side flange 52,54 by a hinge attach 78 and has an opening 79 disposed above it, thus allowing it to be flexible over its length, and particularly in the upwards direction. Living hinge 77 is not attached to any portion of container 10 except at hinge attach 78. Thus, as a side wall (34 or 36) is upwardly raised and an adjacent end wall (44 or 46) is subsequently upwardly raised to receive latching member 66 into the assembled orientation, aperture 76 slidingly receives latching member 66, while raised tooth 74 flexes living hinge 77 upwards from the rest position, causing hinge 77 to be temporarily flexed into opening 79.

In the final assembled position, tooth 74 is latched on the outside of living hinge 77, which has since returned at or near the rest position. Specifically, during the assembled state a lip 83 of living hinge 77 lies in the pocket 81 formed between tooth 74 and upper surface 68 of latch member 66, thereby retaining latching member 66 in a secure manner and providing the stability desired for maintaining container 10 in the assembled position. The depth created by flanges 52,54 allow for a longer latching member 66 than would otherwise be possible.

To collapse container 10 from the assembled orientation, lever 85 of living hinge 77 is raised upwards by the user, and lip 83 is accordingly raised from pocket 81, allowing latching member 66 and its tooth 74 to be released from latch receiver 75.

The reduced stress concentrations of the latches as provided according to the present invention is further shown in FIG. 1. By example, refer to line 80 formed by the mating lateral edges of side wall 34 and end wall 46 (specifically flange 52 of end wall 46). The latching that takes place is spaced apart from corner line 31 which is typically subjected to relatively higher stress concentration forces. Thus, according to the present invention, not only are corner members 28 unitary and integral to base 14 to more fully withstand the stress concentrations, but the latching which in the past has taken place along corner line 31 and was subjected to this stress is according to the present invention remote therefrom to reduce stress in the corners, thus reducing the stress on the latches.

In addition to latching member 66, also provided on each lateral edge (58,60) and (62,64) of side walls 34 and 36 is a relatively large tab member 82. As shown in FIGS. 2 and 5, each large tab member 82 projects from its respective edge of side walls 34 and 36. Also provided on each shorter flange 52 and 54 of end wall 44 is an opening 84 which resembles a narrow slot and which corresponds to large tab member 82 for receiving the same during the assembled container orientation. Opening 84 receives large tab member 82 in a secure fit for providing a manner by which to align and orient the adjoining walls, as well as secondarily assisting in securely holding side walls (36 and 36) and end walls (40 and 42) upright together during the assembled orientation.

Moreover, as is further shown in FIG. 2, upper portion of lateral edges (58, 60) and (62, 64) of side walls 34 and 36, respectively, include a relatively small tab member 86. Like large tab member 82, in the assembled orientation small tab member 86 is received by a corresponding tab opening 88 formed in shorter flanges 52 and 54 of end wall 44,46. Small tab member 86 is generally provided for alignment purposes as well as to provide an additional point of engagement between the adjoining walls.

With reference now directed to FIG. 3, shown therein is container 10 oriented in an inwardly collapsible or folded orientation. Again the term inwardly designates a general direction of movement of the various walls toward base 14 and bottom panel 15. As FIG. 3 clearly indicates, the design according to the present invention allows container 10 to be compactly folded for storage and transport. In this orientation, side walls 34 and 36 are pivoted inward via hinging mechanism 37 and folded in a layered fashion on top of bottom panel 14. FIG. 3 illustrates side wall 34 folded first and side wall 36 subsequently folded thereupon.

In the embodiment shown in FIG. 3, it is noted that, when folded inward, latching member 66 of side wall 36 extends into and rests in an opening 90 with its tooth 74 adjacent vertical wall 92, while latching member 66 of side wall 34 extends into and rests in an opening 94 with its tooth 74 adjacent vertical wall 96. Thus latching member 66 and the length of tooth 74 are such that they do not interfere with any other component, allowing the walls to fold neatly and compactly.

Subsequently end walls 44 and 46 are folded inward on top of side walls 34 and 36 via latching system 48. As is further shown in FIG. 3, the greater relative width of end walls (44 and 46) in comparison to the relatively narrow transverse width of bottom panel 15 from side edge 16 to side edge 18, allows flange portions 52 and 54 of end walls (44 and 46) to enclose laterally side walls 34 and 36. Specifically, when container 10 moves into the inwardly collapsed state of FIG. 3, shorter wall section 42 of side wall 34, which as previously mentioned, in the assembled state is co-planar with bottom panel 15 and forms part of bottom panel 15, now swings up and out of the way to make the bottom narrow (i.e. restore the offset nature of these sides 16,18), thus creating the clearance suitable for flange portions 52 and 54 to swing down into the inwardly collapsed state. Further, in the orientation shown in FIG. 3, flange portions 52 and 54 are co-planar and co-linear with side face portion 31 of corner member 28. As is best illustrated in FIG. 2, it is noted that lower portions 53 and 55 of flange portions 52 and 54 are inwardly offset from the upper flange portions and, therefore, in the inwardly folded orientation of FIG. 3, lower portions 53 and 55 are positioned in a plane parallel to and inward of side face portion 32.

Figure 6C:
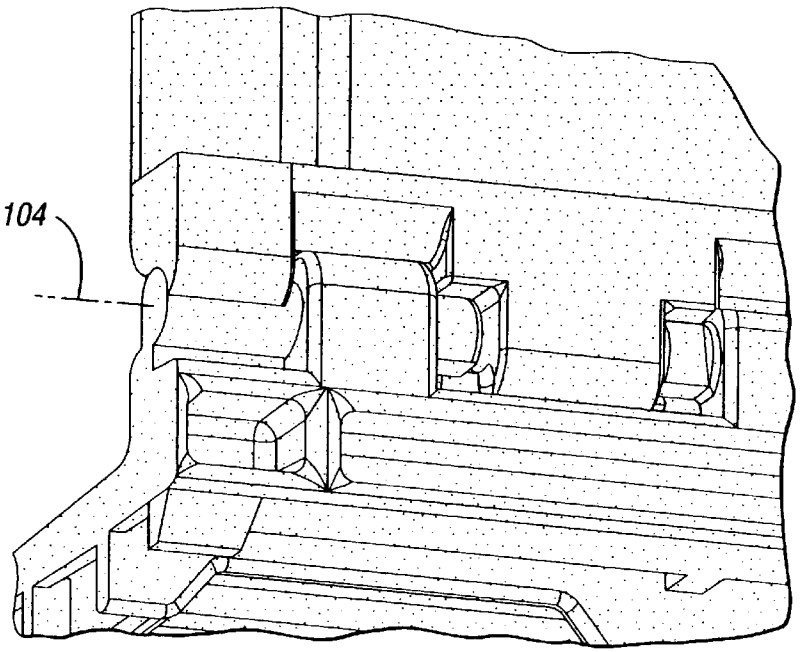
FIG. 6*c* of the drawings is a composite illustration showing the component of FIG. 6*a* mated with the component of FIG. 6*b;*
Figure 6A:
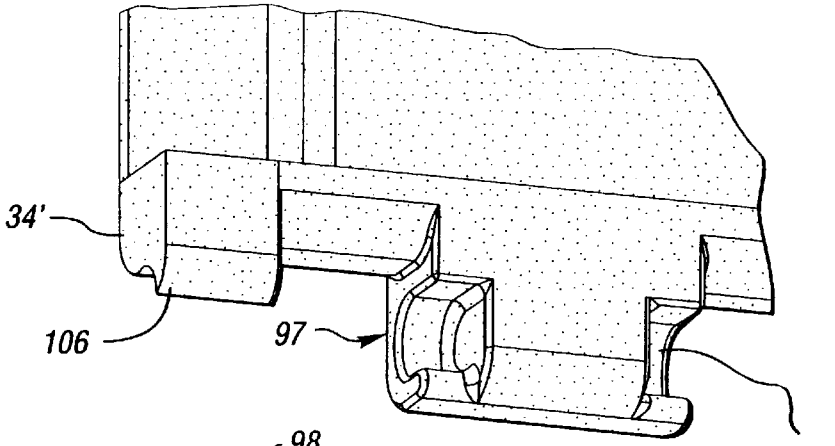
FIG. 6*a* of the drawings illustrates a portion of a second embodiment of a hinging system according to the present invention.
Figure 6B:
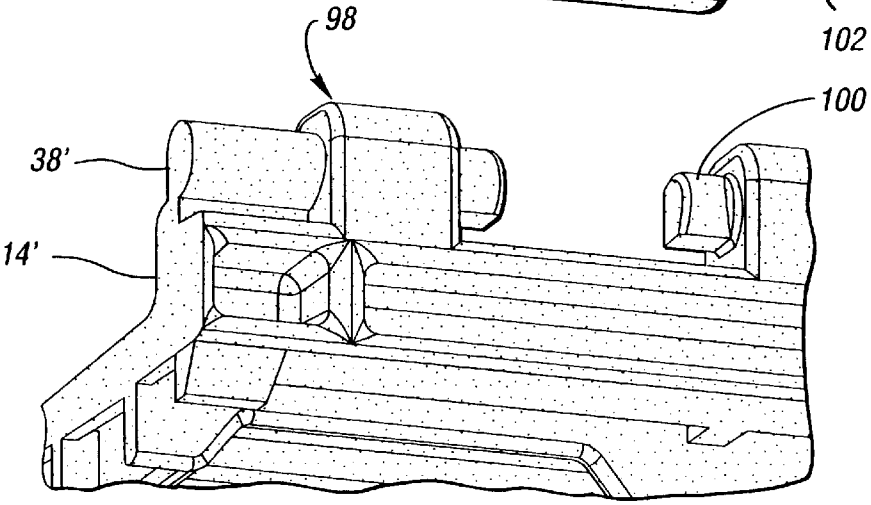
FIG. 6*b* of the drawings illustrates a mating portion to that shown in FIG. 6*a* of a second embodiment of a hinging system according to the present invention.

FIGS. 6*a*–6*c* illustrate an alternative embodiment to the hinging systems 37 previously discussed herein. Similar components will be designated by like reference numerals carrying prime (') designations for consistency and ease of reference. It must be noted for purposes of FIG. 6 that while a component may be arbitrarily designated as a wall or a base, the mating hinging portions disclosed therein may be interchanged (i.e. either may be provided on a wall and either may be provided on an adjoining base). Thus, instead of cylindrical member 38 as in FIGS. 1–3, a wall designated as base 14' of FIG. 6*b* has hinge members 98 which include annular (or semi-annular) projections 100 (or bosses) extending toward adjacent hinge members 98. Shown in FIG. 6*a*, for purposes of example, is a portion of another wall, side wall 34, having hinge receiving members 97 with semi-circular or U-shaped apertures 102 formed therein for securely receiving a corresponding projection 100 in an interference or locking orientation, allowing side wall 34' to pivot around an axis 104 with respect to base 14'. This system provides for stability in three directions, i.e. the directions defining aperture 102. FIG. 6*a* also illustrates a curved member 106 having a surface which mates with cylindrical member 38' for providing stability in a fourth direction.

Again, it bears repeating that as with FIGS. 1–3, it is fully contemplated that hinge receiving members 97 having apertures 102 may just as easily be positioned on base 14', while hinge member 98 having projections 100 accordingly may be formed integral with an adjoining side wall. FIG. 6*c* illustrates a partial assembly according to this embodiment, showing the components of FIGS. 6*a* and 6*b* mated in an alternative hinge assembly.

As shown in FIGS. 1–3, each of side walls (34, 46) and end walls (40, 42) include a hand opening 107 and 108, respectively, ideally suited to be used as a handle in order to carry container 10.

Figure 7:
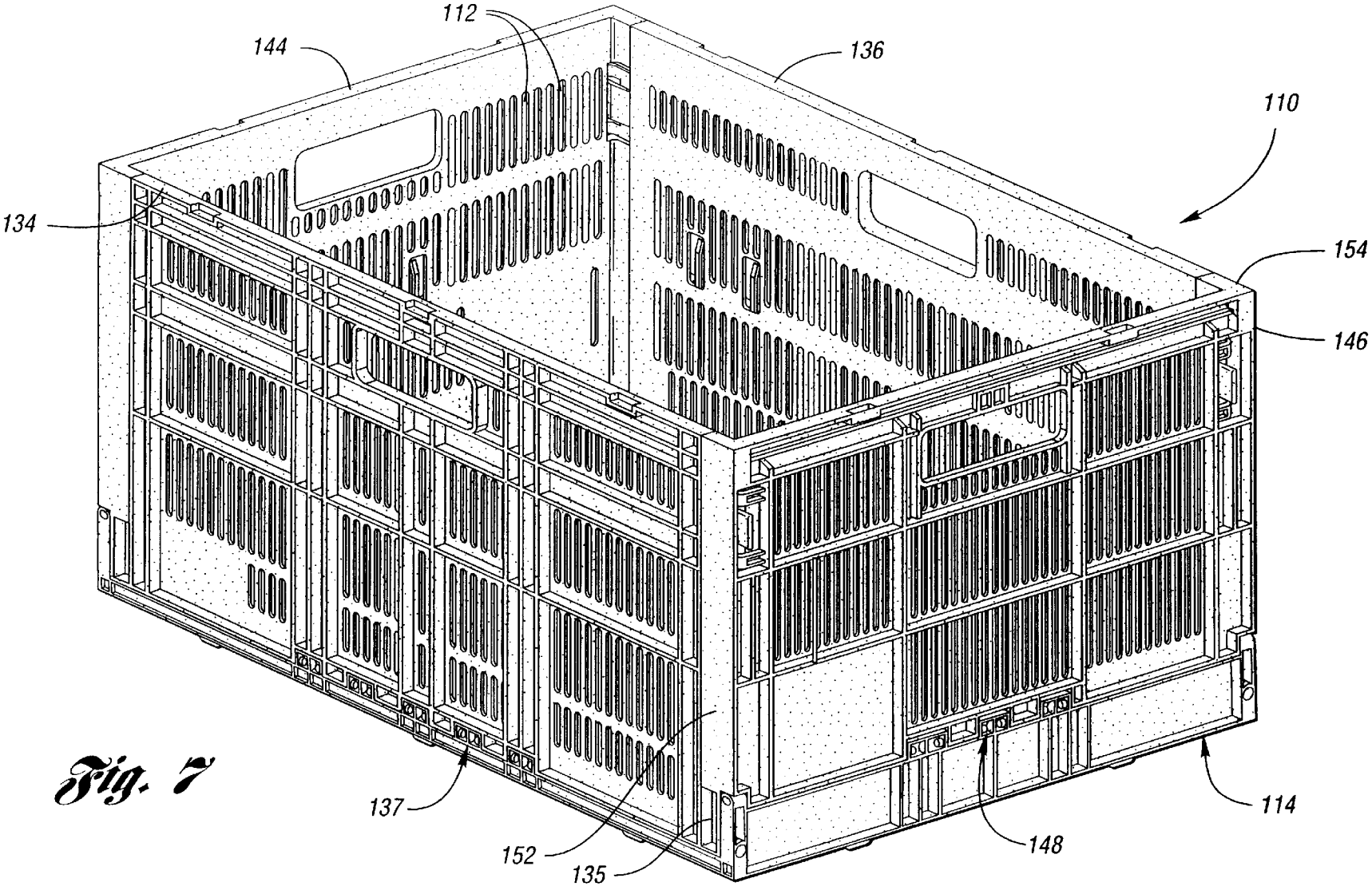
FIG. 7 of the drawings is a perspective view of a second embodiment of a collapsible container according to the present invention.
Figure 8:
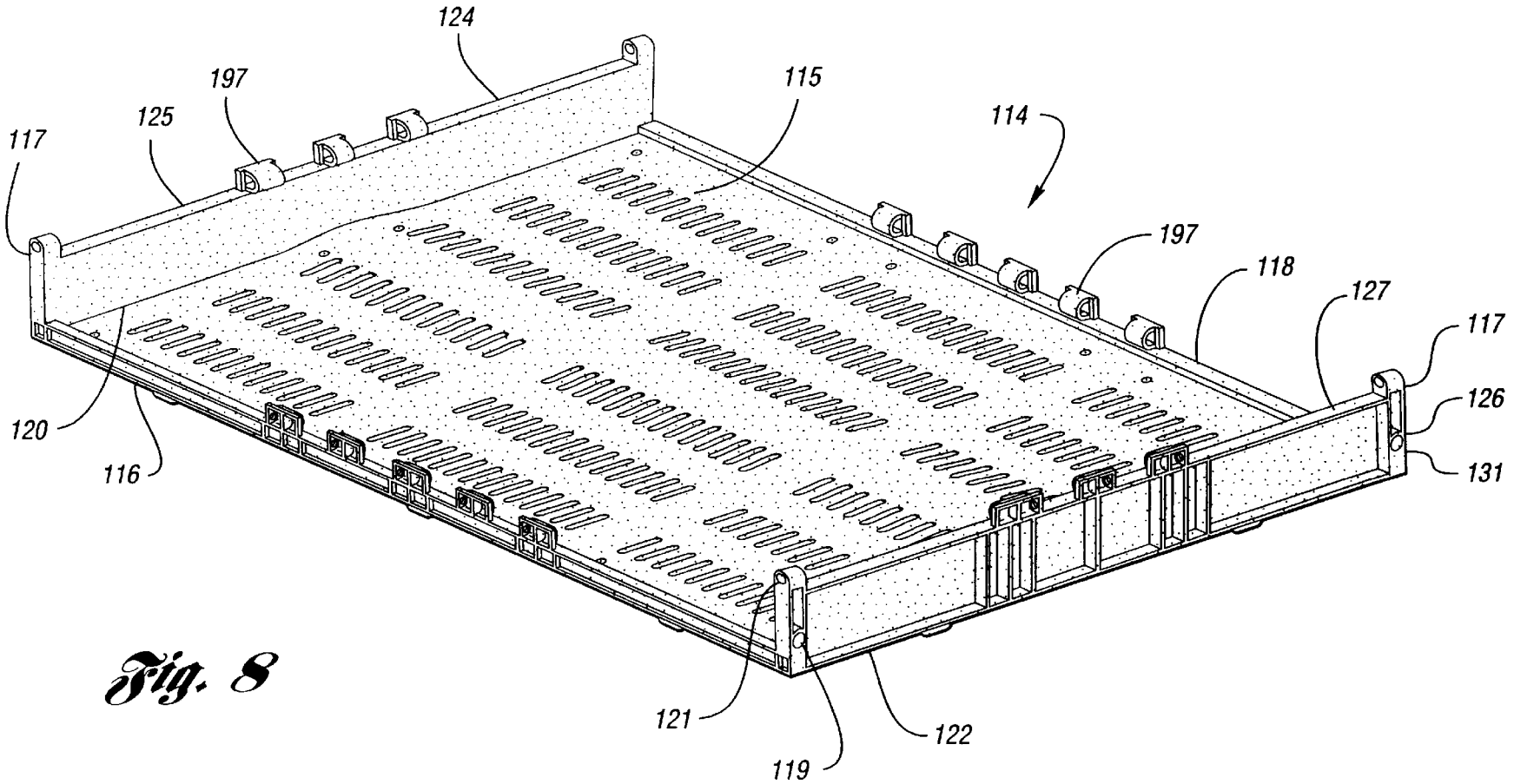
FIG. 8 of the drawings is a perspective view of a base of the second embodiment of the collapsible container shown in FIG. 7.
Figure 9:
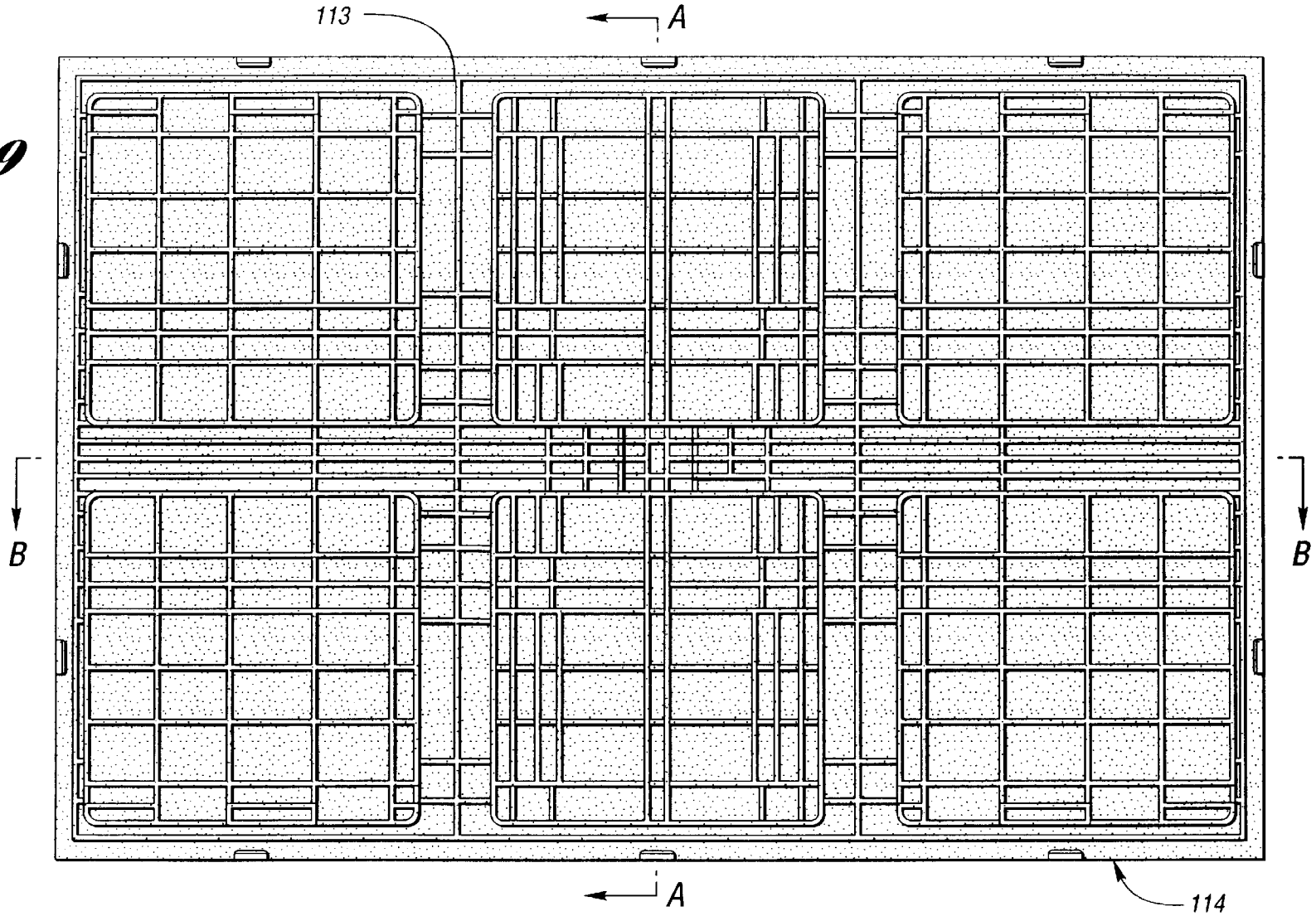
FIG. 9 of the drawings is a bottom plan view of the collapsible container shown in FIG. 8.

With reference to FIGS. 7–9 of the drawings, shown therein is a second embodiment of a collapsible container according to the present invention. Container 110 is shown in FIG. 7 in an assembled orientation. Like the previous embodiment, container 110 is also capable of being collapsed into each of an inwardly folded position and an outwardly folded position in the manner illustrated in FIGS. 2 and 3. Container 110 includes a plurality of slots 112 formed therein for promoting circulation of air and other gases to keep the contents of the container fresh. Further included is a base 114 which is discussed further herein in association with FIGS. 8–9. Container 110 also includes a pair of opposed side walls 134 and 136, as well as a pair of opposed end walls 144 and 146 with flanges 152,154. Each side wall (134,136) and end wall (144, 146) is pivotably attached to base 114.

FIG. 8 illustrates the base 114 of container 110 shown in FIG. 7. Base 114 includes a bottom panel 115 which is rectangular in shape and has opposing side edges 116 and 118, and further includes opposing end edges 120 and 122. A pair of opposed upstanding flanges 124 and 126 is provided and each is formed perpendicular to bottom panel 115. Each upstanding flange 124 and 126 defines an upper side edge 125 and 127, respectively. As with the first embodiment previously disclosed herein, each side wall (134, 136) is pivotally hinged with respect to base 114 at a corresponding side edge (116, 118), while each end wall (144,146) is pivotally hinged with respect to base 114 at a corresponding end upper edge (125, 127). Thus each end wall (144,146) is pivotally attached to base 114 at a distance remote from base 114. Particularly, the distance is defined by the height of upstanding flanges 124 and 126.

With regard to hinging systems of container 110, shown in association with base 114 of FIG. 8 are the lower portions of hinging systems 137 (for side walls) and 148 (for end walls). Specifically, hinging systems 137 and 148 include a plurality of lower hinge members 197 which are integrally formed with base 114 and are similar to the hinging portion 97 illustrated in FIG. 6*a* attached representatively to side wall 34'. As shown in FIG. 8, along each end upper edge (125,127) there is provided three lower hinge members 197, while along each side edge (116,118) there is provided five lower hinge members 197. These lower hinge members 197 are spaced apart and centered along the length of the respective edge. Accordingly, in this embodiment side walls (134,136) and end walls (144,146) of FIG. 7 have a mating hinge portion similar to hinge portion 98 shown in FIG. 6*b* (without cylindrical member 38'), and are similarly operable in relation to adjoining portion 197. Mating hinge portions like 98 are spaced and centered along their respective lower edges of side walls (134,136) and end walls (144,146) for mating with corresponding lower base hinge members 197.

Moreover, each upstanding flange 124 and 126 includes at either end an upstanding mounting post 117 which projects upward past upper edges 125 and 127 and is integrally formed with upstanding flanges 124 and 126. Each mounting post 117 includes two openings 119 and 121 formed therein. Each mounting post 117 also defines a corner line 131. Opening 119 is located relatively lower and opening 121 is located relatively higher along the height of post 117. Each co-linear pair of openings 117 is provided to receive a corresponding projection (not shown in FIG. 8 but similar to projection 100 or 200') provided at each end of a corresponding side wall (134 or 136), for providing an additional pivoting point for each side wall with respect to base 114. Conversely, each co-linear pair of openings 121 share an axis adjacent upper surface (125,127) of upstanding wall 124,126. Openings 121 are provided to receive a corresponding projection or other member provided at either end of each end wall (144, 146) thereby allowing each end wall to pivot with respect to base 114. Thus openings 119 and 121 provide for an additional pivot point and anchor point along the lateral sides of each wall, thus allowing for a stable hinging mechanism.

Figure 10A:
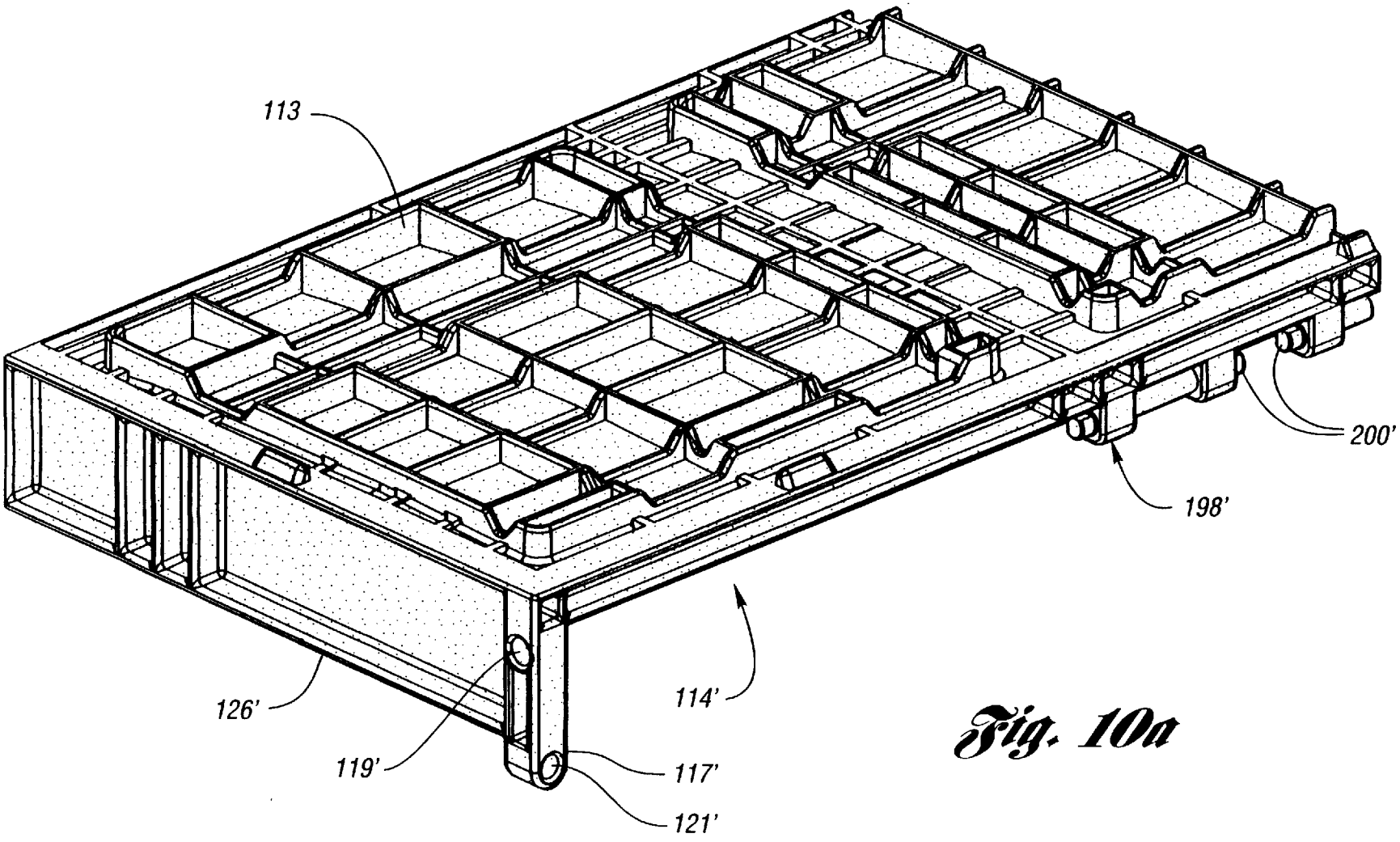
FIG. 10*a* of the drawings is a partial perspective view of the bottom surface of the base of FIG. 9 allowing for nesting of containers.

Referring again to FIG. 10*a*, shown therein is a partial perspective view of a bottom surface 113' a base 114' similar to base 114 in FIGS. 7–9 but having an alternate hinge configuration. As before, similar components in FIGS. 10*a*–10*b* to those in FIGS. 7–9 will be designated by like reference numerals carrying prime (') designations for consistency and ease of reference. Particularly, FIG. 10*a* illustrates a base 114' having hinge members 198' with projections 200' similar to base 14' (with hinge member 98) shown in FIG. 6*b*, but without cylindrical member 38'. Accordingly, a side wall or end wall adapted to mate with base 114' of FIG. 10*a* would thus have a hinging configuration similar to that of hinge portion 97 of FIG. 6*a*, without curved member 106.

Figure 10B:
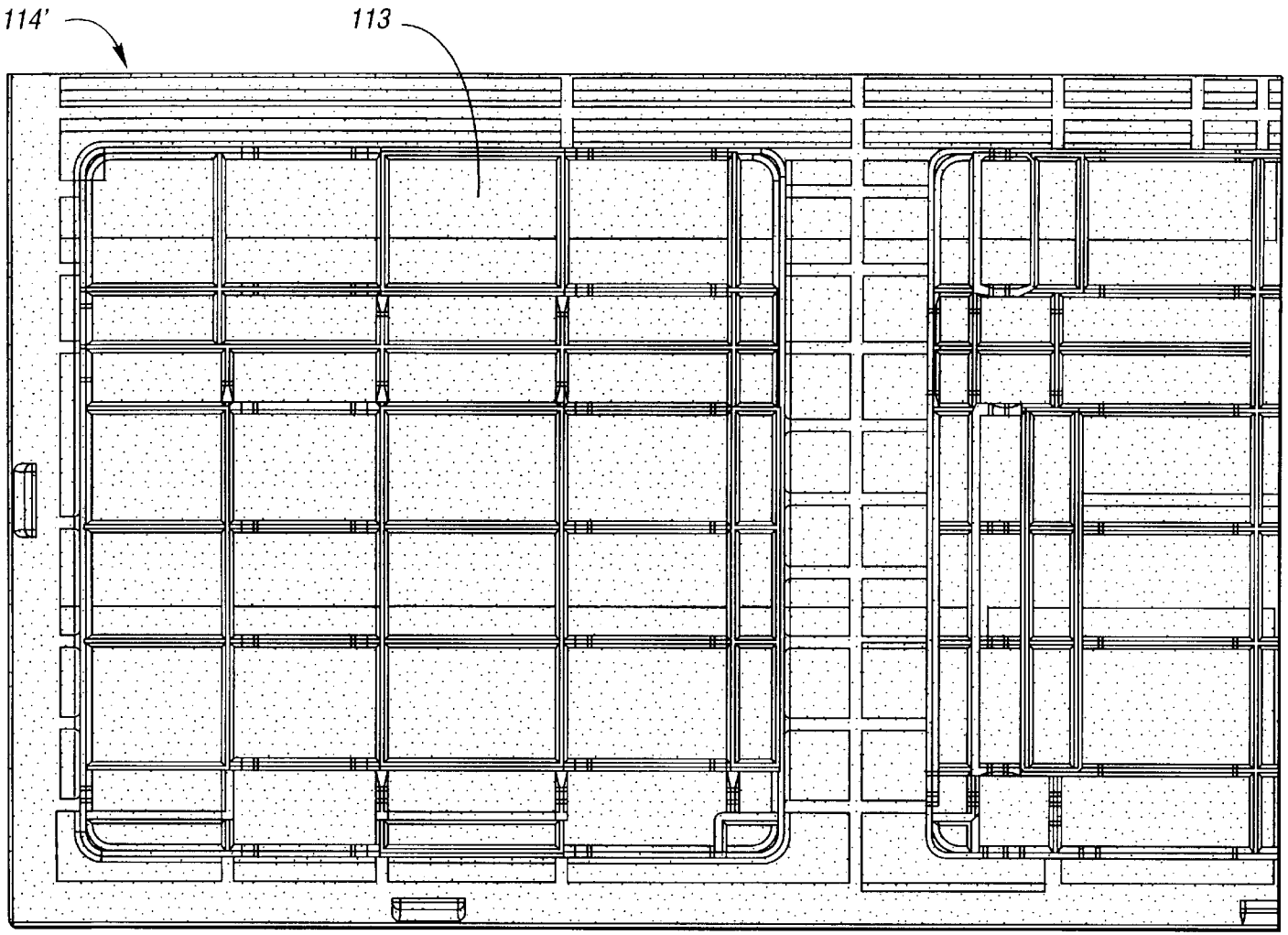
FIG. 10*b* of the drawings is a partial bottom plan view of the embodiment of the base of FIGS. 9 and 10*a* according to the present invention.

FIG. 9 is a bottom plan view, and FIG. 10*b* is a partial plan view, of containers (110, 110'), which share a common bottom surface (113) of base (114,114') and provides a design allowing for nesting of similar containers (110,110') on top of each other when they are in the inwardly folded orientation (as in FIG. 3). This design permits an inwardly collapsed container 10 to be stacked on top of a like folded container so that the resulting stack-up is stable. Particularly, in this nesting orientation, bottom surface 113 would engage end walls (144,146) having a corresponding design as shown in FIG. 7, allowing like containers to securely nest. With such bottom surface design, containers may also be cross stacked. It is of course contemplated that the embodiment shown in FIGS. 1–4 is also capable of nesting with like containers in the fashion described above. FIG. 10*b* is a partial magnified view of the design of FIG. 9, showing generally the corner area bordered by the intersection of lines A—A and B—B of FIG. 9.

It is noted in FIGS. 7–10 that base (114,114') does not have a complete corner section (i.e. no side face portion corresponding to portion 32 of FIGS. 1–3).

Instead, it is noted in this embodiment that side walls (134, 136) have a portion (135) that occupies this area, and which would have the pivot projection corresponding to opening 119. It is also recognized that the latching of the embodiments of FIGS. 7–10 is similar to that shown in FIGS. 1–3 and 5. It is particularly noted that like the other embodiment, the latching herein is remote from the corner line given the similar U-shaped design of end walls 144 and 146 to that of 44 and 46.

Finally, it must be noted that similar components between the embodiments shown in FIGS. 7–10 typically added 100 to the reference numeral of common components of FIGS. 1–5.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A collapsible container, comprising:

a base having first and second pairs of opposing edges, one of the first and second pairs of opposing edges each defined by an upstanding base wall;

a first pair of opposing side walls each pivotably attached to a corresponding one of the first and second pair of opposing edges of the base, each of the first pair of opposing side walls having a pair of opposing lateral flanges inwardly depending therefrom and integral therewith, each lateral flange having a latch receiver formed therein, the latch receiver including an aperture and a flexible latch hinge and having a latch release member actuable by a user; and a second pair of opposing side walls each pivotably attached to a corresponding other of the first and second pairs of opposing edges of the base, each of the second pair of opposing side walls having a pair of opposing lateral edges, each lateral edge having a latching member attached thereto, wherein when the container is oriented in an assembled position, each lateral flange of the first pair of opposing side walls abuts an adjacent lateral edge of the second pair of opposing side walls so that each aperture receives a corresponding latching member which is fastened into position by the latch hinge, thereby forming a secure attachment between the first and second pairs of opposing side walls, and wherein to return the container to a collapsed position from the assembled position, each latch release member is actuated by the user in order to release the latching member fastened therein.

2. The collapsible container of claim 1, wherein when the container is oriented in a first disassembled position, the first and second pairs of opposing side walls are pivotably folded inward so that one of the first and second pairs of opposing side walls is layered between the other of the first and second pairs of opposing side walls and the base, and when the container is oriented in a second disassembled position, the first and second pairs of opposing side walls are pivotably folded outward from the base.

3. The collapsible container of claim 1, wherein each lateral flange of the first pair of opposing side walls has an opening, and each lateral edge of the second pair of opposing side walls has attached thereto an elongate member having a curvature along its length, wherein when the container is oriented in the assembled position, each opening receives a corresponding elongate member to form an interference fit to assist in holding together adjacent side walls.

4. The collapsible container of claim 1, wherein each base wall has a pair of upstanding comer portions formed integrally therewith, each corner potion defining a corner line so that when the container is oriented in the assembled position, each lateral flange abuts an adjacent lateral edge along a line distal from the adjacent corner line.

5. A collapsible container orientable between an assembled position and a collapsed position, comprising:

a base having a pair of opposing upstanding end flanges integral to the base and a pair of opposing side edges extending between the pair of opposing upstanding end flanges;

a pair of opposing side walls pivotably attached to a corresponding one of the opposing side edges of the base, each opposing side wall having a latching member disposed at each lateral edge, the latching member having a pair of opposed tapered surfaces; and a pair of opposing end walls each having a pair of flanges inwardly depending therefrom, the flanges having an aperture and an adjacent latch hinge having a user actuable release portion, the aperture sized for slidingly receiving the pair of opposed tapered surfaces of a corresponding latching member as the container is moved from the collapsed position to the assembled position, and wherein the latching member is secured by the latch hinge in the assembled position, and wherein to release the container from the assembled position, the user actuable release portion is actuated by a user to release the latching member therefrom.

6. The collapsible container of claim 5, wherein each of the pair of opposing upstanding end flanges includes a corner mounting portion at each end having a first opening for receiving a pivot boss from an adjacent side wall, and a second opening for receiving a pivot boss from an adjacent end wall, thereby allowing for additional pivot points between the pair of opposing side walls and the pair of opposing end walls with respect to the base.

7. The collapsible container of claim 5, wherein the latch release members are actuable in a vertical direction.

8. The collapsible container of claim 5, wherein the latch release members are actuable in a horizontal direction.

9. The collapsible container of claim 5, wherein the base includes a plurality of lower hinge members, each lower hinge member having an opening at either end and defined by a flat outer surface and a curved inner surface, each opening for securedly receiving therein a boss member disposed on a corresponding one of the side or end walls for pivotably attaching each wall to the base, wherein during the assembled position the flat portion is co-planar with its corresponding opposing side wall.

10. The collapsible container of claim 5, wherein the base includes a plurality of a corner mounting portions oriented perpendicular to the base and integral therewith, wherein each of the pair of opposing side walls and each of the pair of opposing end walls are pivotably mounted to the corner mounting portions.

11. A foldable container orientable in an assembled state and an inwardly folded collapsed state, comprising:

a bottom panel having a pair of integrally formed opposed upstanding flanged edges, each of the pair of upstanding flanged edges including at each end an integral upstanding corner member having a planar end portion, a planar side portion and defining therebetween a corner line, the bottom panel further having a pair of opposed side edges each situated along a plane inward an adjacent planar side portion;

a pair of opposed side walls having an L-shaped cross-section defined by a long wall portion and a relatively short wall portion, the short wall portion pivotably attached to a corresponding one of the pair of opposed side edges, so that when the container is oriented in the assembled state the short wall portion forms a co-planar extension of the base and the long wall portion is co-planar with the planar side portion, each of the opposed side walls further having a latching member disposed at each lateral edge, the latching member having upper and lower curved surfaces; and a pair of opposed end walls, each pivotably attached to a corresponding one of the upstanding flanged edges and having a U-shaped cross-section including a longer main wall portion and a pair of relatively shorter flanged portions attached to the main wall portion and inwardly directed therefrom, each flanged portion having a flexible latch hinge and an adjacent aperture formed therein correspondingly shaped to slidingly receive the latching member, wherein when the container is oriented in the assembled state, the pair of side walls and the pair of end walls are upstanding so that the latching member is disposed in the aperture and locked into position by the latch hinge, and when the container is oriented in the inwardly folded collapsed state, each of the end walls and side walls is folded inward so that the pair of opposed side walls is disposed between the bottom panel and the pair of end walls, so that each shorter flanged portion abuts a corresponding planar side portion of a respective corner member.

12. The foldable container of claim 11, wherein the container is also orientable in an outwardly folded collapsible state wherein the pair of side panels is co-planar with the bottom panel.

13. The collapsible container of claim 1, wherein the latch release members are actuable in a vertical direction.

14. The collapsible container of claim 1, wherein the latch release members are actuable in a horizontal direction.

15. The collapsible container of claim 1, wherein each latching member has at least one tapered surface.

16. The collapsible container of claim 1, wherein the base includes a plurality of lower hinge members, each lower hinge member defined by a flat outer surface and a curved inner surface and having an opening at either end, each opening for pivotably and securedly receiving therein a boss member disposed on a corresponding wall, wherein during the assembled position the flat portion is co-planar with its corresponding side wall.

17. A collapsible container, comprising:

a base having first and second pairs of opposing edges, one of the first and second pairs of opposing edges defined by an upstanding base wall, and each of the first and second pairs of opposing edges including a respective first and second plurality of lower hinge members, each of the first and second plurality of lower hinge members defined by a flat outer surface and a curved inner surface and having an opening at either end;

a first pair of opposing side walls, each having a plurality of first pivot boss members attached thereto for being pivotally and securedly received in the opening of a corresponding one of the first plurality of lower hinge members, each of the first pair of opposing side walls having a pair of opposing lateral flanges inwardly depending therefrom and integral therewith, each lateral flange having a latch receiving portion formed therein, the latch receiving portion including an aperture adjacent a flexible latch hinge having a latch release member which is actuable by a user; and a second pair of opposing side walls each having a plurality of second pivot boss members attached thereto for being pivotally and securedly received in the opening of a corresponding one of the second plurality of lower hinge members, each of the second pair of opposing side walls having a pair of opposing lateral edges, each lateral edge having at least one latching member projecting therefrom, wherein when the container is oriented in an assembled position, each lateral flange of the first pair of opposing side walls abuts an adjacent lateral edge of the second pair of opposing side walls so that the aperture receives a corresponding latching member which is fastened into position by the latch hinge, thereby forming a secure attachment between the first and second pairs of opposing side walls, and wherein the assembled position, the flat portion of lower hinge portion is co-planar with its corresponding opposing side wall, each opening for securedly receiving therein a boss member disposed on the corresponding wall portion, and wherein to return the container to a collapsed orientation, the user actuates the latch release member thereby releasing the latching member secured therein.

18. The collapsible container of claim 17 wherein each latching member has at least one tapered surface.

* * * * *

UNITED STATES PATENT AND TRADEMARK OFFICE

CERTIFICATE OF CORRECTION

PATENT NO : 6,015,056

DATED : January 18, 2000

INVENTOR(S) : TRENTON M. OVERHOLT ET AL.

It is certified that error appears in the above-identified patent and that said Letters Patent is hereby corrected as shown below:

Column 11, Line 46, Claim 4: delete "comer" and insert --corner--.

Signed and Sealed this

Twenty-first Day of November, 2000

*Attest:*

Q. TODD DICKINSON

*Attesting Officer*

*Director of Patents and Trademarks*